US011372438B2

(12) United States Patent
Jeon

(10) Patent No.: US 11,372,438 B2
(45) Date of Patent: Jun. 28, 2022

(54) STARTUP CIRCUIT AND BANDGAP REFERENCE CIRCUIT

(71) Applicant: Samsung Electro-Mechanics Co., Ltd., Suwon-si (KR)

(72) Inventor: Hyun Goo Jeon, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/944,258

(22) Filed: Jul. 31, 2020

(65) Prior Publication Data

US 2021/0356981 A1 Nov. 18, 2021

(30) Foreign Application Priority Data

May 14, 2020 (KR) ..... 10-2020-0057793

(51) Int. Cl.
*G05F 3/24* (2006.01)
*G05F 1/46* (2006.01)

(52) U.S. Cl.
CPC ..... *G05F 3/24* (2013.01); *G05F 1/468* (2013.01)

(58) Field of Classification Search
CPC ..... G05F 1/36; G05F 1/468; G05F 3/24
See application file for complete search history.

(56) References Cited

U.S. PATENT DOCUMENTS

2018/0217625 A1* 8/2018 Huang ..... G05F 3/30
2020/0278713 A1* 9/2020 Hashemi ..... G05F 3/205

FOREIGN PATENT DOCUMENTS

JP 2005-327035 A 11/2005
KR 10-2001-0058367 A 7/2001

* cited by examiner

*Primary Examiner* — Kyle J Moody
*Assistant Examiner* — Lakaisha Jackson
(74) *Attorney, Agent, or Firm* — NSIP Law

(57) ABSTRACT

A startup circuit is provided. The startup circuit includes a first switch connected between an operating voltage terminal and a first connection node, and configured to perform a switching operation based on a shutdown signal, a second switch connected between the first connection node and ground, and configured to perform a switching operation based on a bandgap voltage, a logic circuit performing a logical AND operation on a first voltage of the first connection node and an enabling signal to generate a switching voltage, and a third switch connected between an output node and the ground, and configured to perform a switching operation based on the switching voltage, where the output node outputs a startup voltage.

20 Claims, 5 Drawing Sheets

STARTUP CIRCUIT AND BANDGAP REFERENCE CIRCUIT

CROSS-REFERENCE TO RELATED APPLICATION(S)

This application claims the benefit under 35 USC 119(a) of Korean Patent Application No. 10-2020-0057793 filed on May 14, 2020 in the Korean Intellectual Property Office, the entire disclosure of which is incorporated herein by reference for all purposes.

BACKGROUND

1. Field

The following description relates to a startup circuit and a bandgap reference circuit.

2. Description of Related Art

Typically, a wireless communication terminal may include a low noise amplifier (LNA) and a power amplifier (PA) to amplify an input signal.

The LNA may utilize a reference voltage to generate a bias voltage to amplify the input signal, and the reference voltage may be provided by a reference circuit.

Typically, the reference circuit may include a bandgap reference (BGR) circuit and a regulator (e.g., low drop-out (LDO) regulator).

Specifically, in examples where the LNA and the PA, applied to a time division duplex (TDD) type wireless communication terminal, receive the reference voltage through the reference circuit and perform normal operations, a turn-on time of each of the LNA and the PA may be affected by a turn-on time of the reference circuit.

Therefore, a fast turn-on of the reference circuit may be desired for fast driving of each of the LNA and the PA, and a startup circuit may be desired for the fast driving of the reference circuit.

A typical startup circuit, for example, may include a plurality of transistors and resistors. Such a typical startup circuit including the transistors and resistors may inevitably result in a response delay due to an element feature thereof, and may thus have a limitation in a rapid supply of the reference voltage.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, a startup circuit includes a first switch, connected between an operating voltage terminal and a first connection node, and configured to perform a switching operation based on a shutdown signal, a second switch, connected between the first connection node and a ground, and configured to perform a switching operation based on a bandgap voltage, a logic circuit configured to perform a logical AND operation on a first voltage of the first connection node and an enabling signal, to generate a switching voltage; and a third switch, connected between an output node and the ground, and configured to perform a switching operation based on the switching voltage, wherein the output node outputs a startup voltage.

The first switch may include a field effect transistor (FET) which has a source connected to the operating voltage terminal, a drain connected to the first connection node through a first resistor, and a gate through which the shutdown signal is input.

The second switch may include a field effect transistor (FET) which has a drain connected to the first connection node, a source connected to the ground, and a gate through which the bandgap voltage is input.

The third switch may include a field effect transistor (FET) which has a drain connected to the output node, a source connected to the ground, and a gate through which the switching voltage is input.

The logic circuit may include a logic AND gate which has a first input terminal, connected to the first connection node, and configured to receive the first voltage, a second input terminal, configured to receive the enabling signal; and an output terminal, configured to output the switching voltage which has a voltage level that is based on a result of the logical AND operation performed between the first voltage and the enabling signal.

The logic AND gate may output the switching voltage which has a high voltage level when both the first voltage and the enabling signal have the high voltage level.

The high voltage level of the switching voltage may be equal to a voltage level of the operating voltage.

The startup circuit may include a fourth switch connected between the operating voltage terminal and the output node, and configured to perform a switching operation based on the enabling signal, wherein the fourth switch includes a field effect transistor (FET) which has a source connected to the operating voltage terminal, a drain connected to the output node, and a gate through which the enabling signal is input.

In a general aspect, a bandgap reference circuit includes a startup circuit configured to generate a startup voltage; and a bandgap reference core circuit configured to generate a bandgap voltage based on the startup voltage to start operations, wherein the startup circuit comprises: a first switch, connected between an operating voltage terminal and a first connection node, and configured to perform a switching operation based on a shutdown signal; a second switch, connected between the first connection node and a ground, and configured to perform a switching operation based on the bandgap voltage; a logic circuit configured to perform a logical AND operation on a first voltage of the first connection node and an enabling signal, to generate a switching voltage; and a third switch, connected between an output node and the ground, and configured to perform a switching operation based on the switching voltage, wherein the output node outputs a startup voltage.

The first switch may include a field effect transistor (FET) which has a source connected to the operating voltage terminal, a drain connected to the first connection node through a first resistor, and a gate through which the shutdown signal is input.

The second switch may include a field effect transistor (FET) which has a drain connected to the first connection node, a source connected to the ground, and a gate through which the bandgap voltage is input.

The third switch may include a field effect transistor (FET) which has a drain connected to the output node, a source connected to the ground, and a gate through which the switching voltage is input.

The logic circuit may include a logic AND gate which has: a first input terminal, connected to the first connection node, and configured to receive the first voltage; a second input terminal, configured to receive the enabling signal; and an output terminal, configured to output the switching voltage which has a voltage level that is based on a result of the logical AND operation performed between the first voltage and the enabling signal.

The logic AND gate may output the switching voltage which has a high voltage level when both the first voltage and the enabling signal have the high voltage level.

The high voltage level of the switching voltage may be equal to a voltage level of the operating voltage.

The startup circuit may further include a fourth switch connected between the operating voltage terminal and the output node, and configured to perform a switching operation based on the enabling signal, wherein the fourth switch includes a field effect transistor (FET) which has a source connected to the operating voltage terminal, a drain connected to the output node, and a gate through which the enabling signal is input.

In a general aspect, a communication terminal includes a bandgap reference circuit including a startup circuit and a bandgap reference core circuit, wherein the startup circuit is configured to: generate a startup voltage based on an operating voltage, an enabling signal, a shutdown signal, and a bandgap voltage received from the bandgap reference core circuit, and output the generated startup voltage to the bandgap reference core circuit; and wherein the bandgap reference core circuit is configured to generate a bandgap voltage and start operations based on the operating voltage and the startup voltage.

The startup circuit may include a first switch, connected between an operating voltage terminal and a first connection node, and configured to perform a switching operation based on the shutdown signal; a second switch, connected between the first connection node and a ground, and configured to perform a switching operation based on a bandgap voltage; a logic circuit configured to perform a logical AND operation on a first voltage of the first connection node and the enabling signal, to generate a switching voltage; and a third switch, connected between an output node and the ground, and configured to perform a switching operation based on the switching voltage.

A value of the startup voltage may decrease when a value of a startup current flowing through the third switch increases.

Other features and aspects will be apparent from the following detailed description, the drawings, and the claims.

Figure 1:
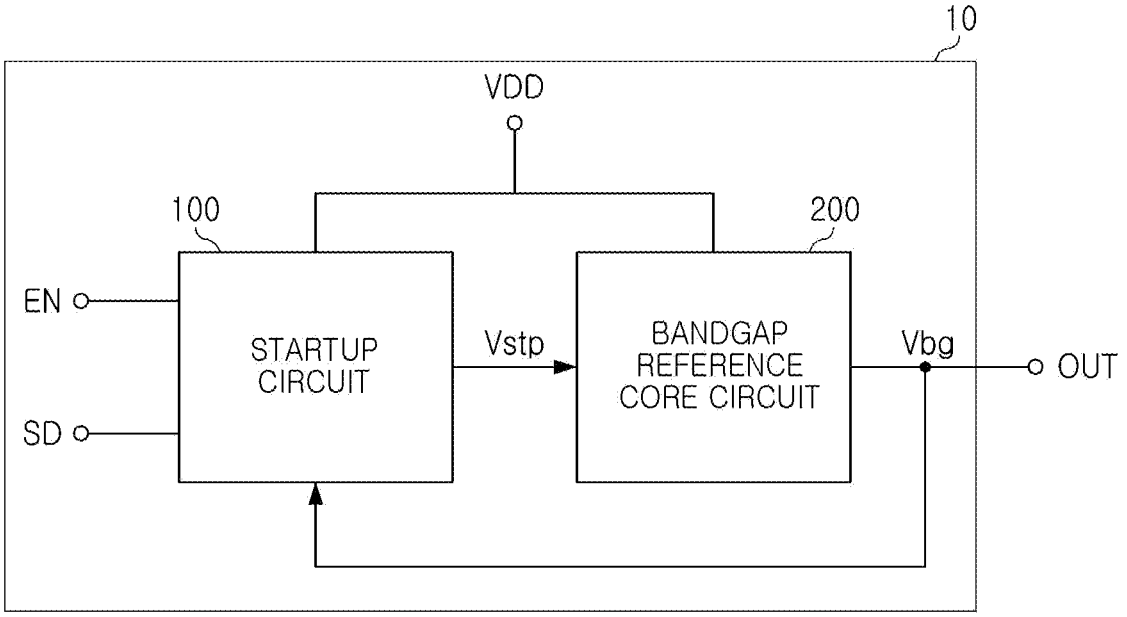
FIG. 1 illustrates an example bandgap reference circuit, in accordance with one or more embodiments.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Unless otherwise defined, all terms, including technical and scientific terms, used herein have the same meaning as commonly understood by one of ordinary skill in the art to which this disclosure pertains after an understanding of the disclosure of this application. Terms, such as those defined in commonly used dictionaries, are to be interpreted as having a meaning that is consistent with their meaning in the context of the relevant art and the disclosure of the present application, and are not to be interpreted in an idealized or overly formal sense unless expressly so defined herein.

FIG. 1 illustrates an example bandgap reference circuit, in accordance with one or more embodiments.

Referring to FIG. 1, a bandgap reference circuit 10, in accordance with one or more embodiments may include a startup circuit 100, and a bandgap reference core circuit 200.

The startup circuit 100 may receive an operating voltage VDD. The startup circuit 100 may also generate a startup voltage Vstp based on a received enabling signal EN, a shutdown signal SD and a bandgap voltage Vbg, and output the generated Vstp to the bandgap reference core circuit 200. Herein, it is noted that use of the term 'may' with respect to an example or embodiment, e.g., as to what an example or embodiment may include or implement, means that at least one example or embodiment exists where such a feature is included or implemented while all examples and embodiments are not limited thereto.

The bandgap reference core circuit 200 may generate the bandgap voltage Vbg based on the received operating voltage VDD and the received startup voltage Vstp, which is received from the startup circuit 100. The bandgap reference core circuit 200 may start operations based on the received operating voltage VDD and the received startup voltage Vstp.

Figure 2:
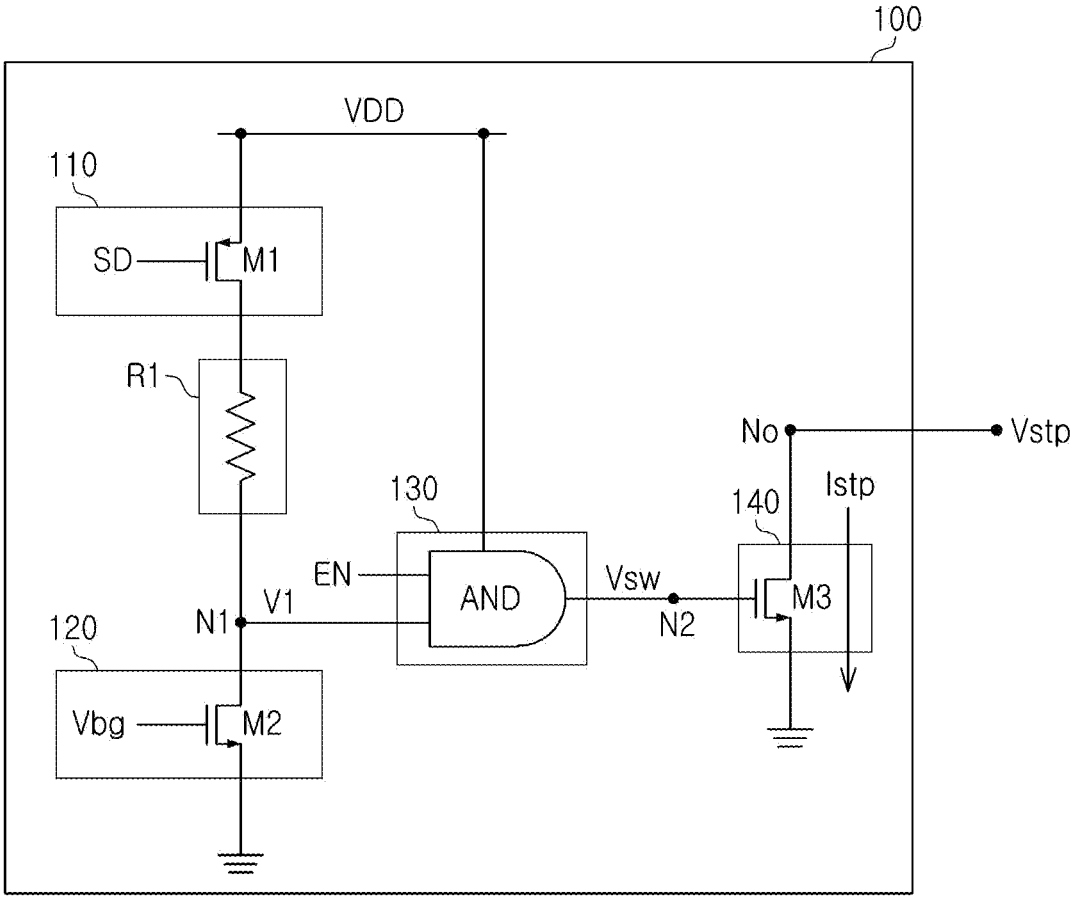
FIG. 2 illustrates an example startup circuit, in accordance with one or more embodiments.

FIG. 2 illustrates an example startup circuit, in accordance with one or more embodiments.

Referring to FIG. 2, the startup circuit 100 may include: a first switch 110, a second switch 120, a logic circuit 130, and a third switch 140.

In the respective drawings, an unnecessary overlapping description for components denoted by the same reference numerals and having the same functions will be omitted, and contents different from each other in the respective drawings will be described.

Figure 3:
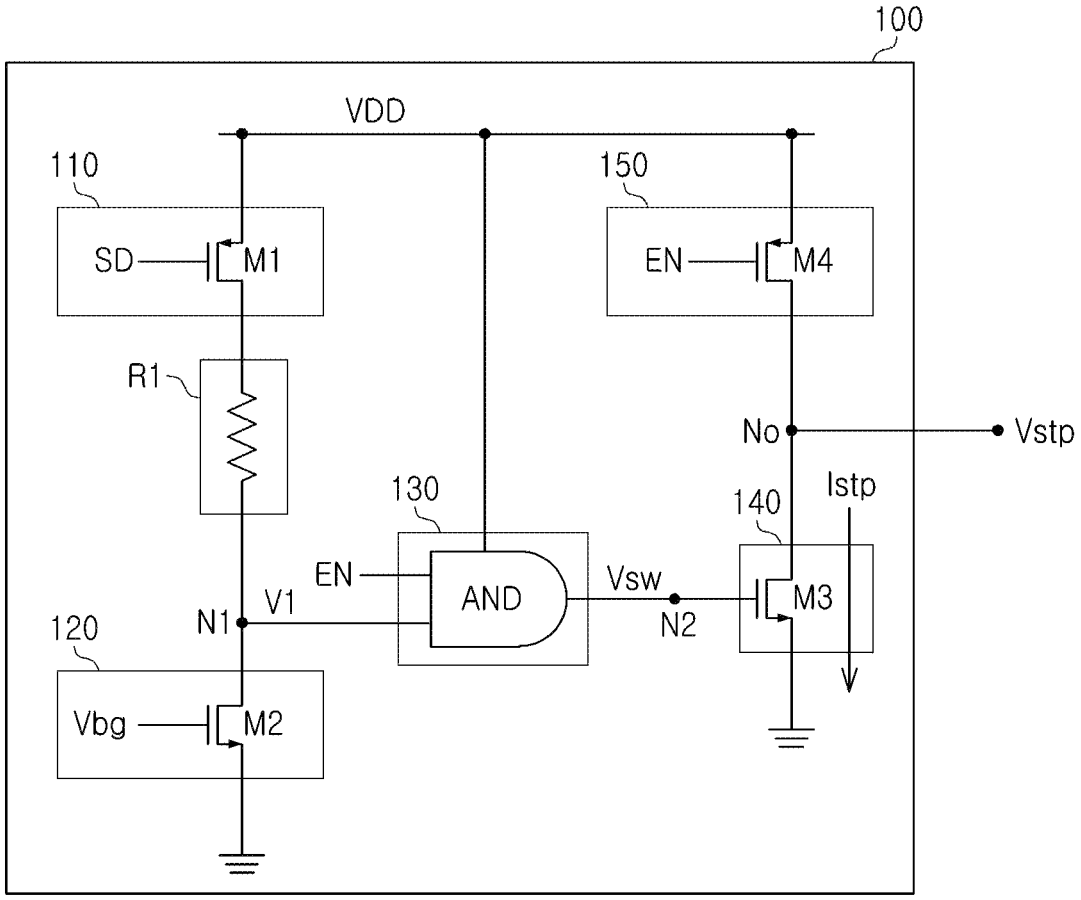
FIG. 3 illustrates an example startup circuit, in accordance with one or more embodiments.

FIG. 3 illustrates an example startup circuit, in accordance with one or more embodiments.

Referring to FIG. 3, the startup circuit 100 may include a first switch 110, a second switch 120, a logic circuit 130, a third switch 140, and a fourth switch 150.

Referring to FIGS. 2 and 3, in an example, the first switch 110 may be connected between an operating voltage VDD terminal and a first connection node N1 to perform a switching operation based on the shutdown signal SD.

The second switch 120 may be connected between the first connection node N1 and ground to perform a switching operation based on the bandgap voltage Vbg.

The logic circuit 130 may perform a logical AND operation on a first voltage V1 of the first connection node N1 and the enabling signal EN to generate a switching voltage Vsw.

The third switch 140 may be connected between an output node No outputting the startup voltage Vstp and the ground to perform a switching operation based on the switching voltage Vsw.

Referring to FIG. 3, the fourth switch 150 may be connected between the operating voltage VDD terminal and the output node No to perform a switching operation based on the enabling signal EN.

Additionally, referring to FIGS. 2 and 3, in an example, the first switch 110 may include a P-channel field effect transistor (FET) M1.

The P-channel field effect transistor (FET) M1 may have a source connected to the operating voltage VDD terminal, a drain connected to the first connection node N1 through a first resistor R1 and a gate through which the shutdown signal SD is input.

In an example, the P-channel FET M1 may be turned off when the shutdown signal SD has a high voltage level. The P-channel FET M1 may be turned on when the enabling signal EN has the high voltage level and the shutdown signal SD has a low voltage level, and the startup circuit 100 may thus start operations.

In an example, the second switch 120 may include an N-channel field effect transistor (FET) M2.

The N-channel field effect transistor (FET) M2 may have a drain connected to the first connection node N1, a source connected to the ground and a gate through which the bandgap voltage Vbg is input.

In an example, the N-channel FET M2 may be turned off in an example where there is no output voltage of the startup circuit 100 and thus the bandgap voltage Vbg has the low voltage level, and may be turned on in an example where the bandgap voltage Vbg has the high voltage level based on the operation of the startup circuit 100.

In an example, the third switch 140 may include an N-channel field effect transistor (FET) M3.

The N-channel field effect transistor (FET) M3 may have a drain connected to the output node No, a source connected to the ground and a gate through which the switching voltage Vsw is input.

For example, the N-channel FET M3 may be turned on in an example where the switching voltage Vsw output from the logic circuit 130 has the high voltage level, thereby allowing a startup current Istp to rapidly flow from the output node No to the ground to rapidly drop the startup voltage Vstp. Then, the N-channel FET M3 may be turned off in an example where the startup voltage Vstp has the low voltage level, and thus the switching voltage Vsw may have the low voltage level.

The logic circuit 130 may include, for example, a logic AND gate "AND", a logic element.

The logic AND gate "AND" may have a first input terminal connected to the first connection node N1 and configured to receive the first voltage V1, a second input terminal configured to receive the enabling signal EN, and an output terminal configured to output the switching voltage Vsw having a voltage level reflecting a result of the logical AND operation performed between the first voltage V1 and the enabling signal EN.

In an example, the logic AND gate "AND" may output the switching voltage Vsw having the high voltage level in case that both the first voltage V1 and the enabling signal EN have the high voltage level.

Alternatively, the logic AND gate "AND" may output the switching voltage Vsw having the low voltage level in an example where either the first voltage V1 or the enabling signal EN has the low voltage level.

In an example, the high voltage level of the switching voltage Vsw may be the same as a voltage level of the operating voltage VDD. In an example where the operating voltage VDD is 3.5V, the switching voltage Vsw may also have the high voltage level of 3.5V.

In an example, the logic AND gate "AND" may output the switching voltage Vsw having the high voltage level in an example where both the first voltage V1 and the enabling signal EN have the high voltage level during the time in which the enabling signal EN has the high voltage level and simultaneously the startup circuit 100 has yet to perform normal operations.

Then, the logic AND gate "AND" may output the switching voltage Vsw having the low voltage level in an example where the startup circuit 100 performs normal operations, and the N-channel FET M2 is thus turned on, thereby allowing the first voltage V1 to have the low voltage level.

The fourth switch 150, for example, may include a P-channel field effect transistor (FET) M4.

The P-channel field effect transistor (FET) M4 may have a source connected to the operating voltage VDD terminal, a drain connected to the output node No and a gate through which the enabling signal EN is input.

In an example, the P-channel FET M4 may be turned on where the enabling signal EN has the low voltage level, and may supply the operating voltage VDD to the output node No. In this example, the startup voltage Vstp may become the operating voltage VDD, and then the bandgap reference core circuit 200 may not perform its operation.

Then, the P-channel FET M4 may be turned off in an example where the enabling signal EN has the high voltage level, and the startup circuit 100 may thus start operations.

Still referring to FIG. 3, the startup voltage Vstp may be rapidly decreased as an amount of the startup current Istp flowing through the N-channel FET M3 of the third switch 140 is increased. That is, the amount of the startup current Istp may be increased as a gate-source voltage of the N-channel FET M3 of the third switch 140 is increased.

If the circuit of FIG. 3 is a circuit without the logic circuit 130, i.e. a typical circuit, the N-channel FET M3 of the third switch 140 may have a gate voltage that is lower than the operating voltage VDD. However, in a non-limiting example, the gate-source voltage Vgs of the N-channel FET M3 may become the operating voltage VDD in an example where the N-channel FET M3 of the third switch 140 performs its operation. Therefore, the gate-source voltage Vgs of the N-channel FET M3 may become a higher voltage than the gate voltage of the typical circuit, thereby dropping the startup voltage Vstp more rapidly.

In the typical circuit that does not include the logic circuit 130, when the startup voltage Vstp is decreased below a predetermined voltage and the bandgap reference core circuit 200 thus starts its operation, the bandgap voltage Vbg output from the bandgap reference core circuit 200 may be increased, thereby generating an on-resistance Ron of the N-channel FET M2 of the second switch 120. In this instance, due to the on-resistance of the N-channel FET M2 of the second switch 120, the first voltage V1 of the first connection node N1 may be decreased as the bandgap voltage Vbg is increased.

Accordingly, the startup current Istp of the N-channel FET M3 of the third switch 140 may also be gradually decreased. As a result, the time needed for the bandgap reference circuit 10 to perform normal operations may become longer based on an on-resistance Ron of the N-channel FET M3 shown in Equation 1 below.

$$Ron=L/\{kn(Vgs-Vth)\} \quad \text{Equation 1:}$$

In Equation 1 above, Vgs may indicate the gate-source voltage of the N-channel FET M3, Vth may indicate a threshold voltage of N-channel FET M3, kn may indicate a constant, and L may indicate a gate length of N-channel FET M3.

However, in the startup circuit 100 including the logic circuit 130, the gate voltage of the N-channel FET M3 of the third switch 140 may be the same as the output voltage of the logic circuit 130. Therefore, although the bandgap voltage Vbg is increased, the operating voltage VDD may be maintained and a predetermined amount of startup current Istp may flow through the N-channel FET M3 of the third switch 140 until the bandgap reference circuit 10 performs normal operations.

Additionally, referring to FIG. 3, the P-channel FET M1 of the first switch 110 may receive the shutdown signal SD, and the startup circuit 100 and the bandgap reference core circuit 200 may then perform their normal operations, thereby allowing the bandgap reference core circuit 200 to output a normal bandgap voltage Vbg.

Then, as the bandgap voltage Vbg is increased, if the N-channel FET M2 of the second switch 120 is turned on, the first voltage V1 of the first node N1 may have the low voltage level, the logic circuit 130 may subsequently output the switching voltage Vsw having the low voltage level to a second connection node N2, the N-channel FET M3 of the third switch 140 may accordingly be turned off based on the switching voltage Vsw having the low voltage level, and the startup voltage Vstp may thus have the high voltage level.

First, in an example where the bandgap reference circuit 10 is not driven, (i.e., EN has the low voltage level and SD has the high voltage level), both the P-channel FET M1 of the first switch 110 and the logic circuit 130 may be turned off, thereby consuming no current.

Next, in an example where the bandgap reference circuit 10 is driven from turn-off to turn-on, (i.e., EN has the high voltage level and SD has the low voltage level), although the bandgap reference circuit 10 is turned on, the bandgap voltage Vbg may initially have its voltage level of zero V. Therefore, the N-channel FET M2 of the second switch 120 may still be turned off, and thus the first voltage V1 of the first connection node N1 may almost be the operating voltage VDD.

As such, in an example where the first voltage V1 of the first connection node N1 becomes the operating voltage VDD, the switching voltage Vsw of the second connection node N2, the output node of the logic circuit 130, may be changed to the operating voltage VDD, thereby turning on the N-channel FET M3 of the third switch 140 to drop the startup voltage Vstp, the bias voltage of a bandgap reference core circuit 200.

In an example where the startup voltage Vstp is decreased, the bandgap reference core circuit 200 may perform normal operations, thereby increasing the bandgap voltage Vbg, and in an example where the bandgap voltage Vbg becomes higher than the threshold voltage Vth of the N-channel FET M2 of the second switch 120, the N-channel FET M2 of the second switch 120 may be turned on. In an example, the first voltage V1 of the first connection node N1 may be decreased, and may have the low voltage level, and the switching voltage Vsw output from the logic AND gate AND of the logic circuit 130 may thus be changed to have the voltage level of zero V.

As described above, in an example where the switching voltage Vsw has the voltage level of zero V, the N-channel FET M3 of the third switch 140 may be turned off, based on the switching voltage Vsw having the low voltage level, thereby stopping the operation of the startup circuit 100 and consuming no further current.

Figure 4:
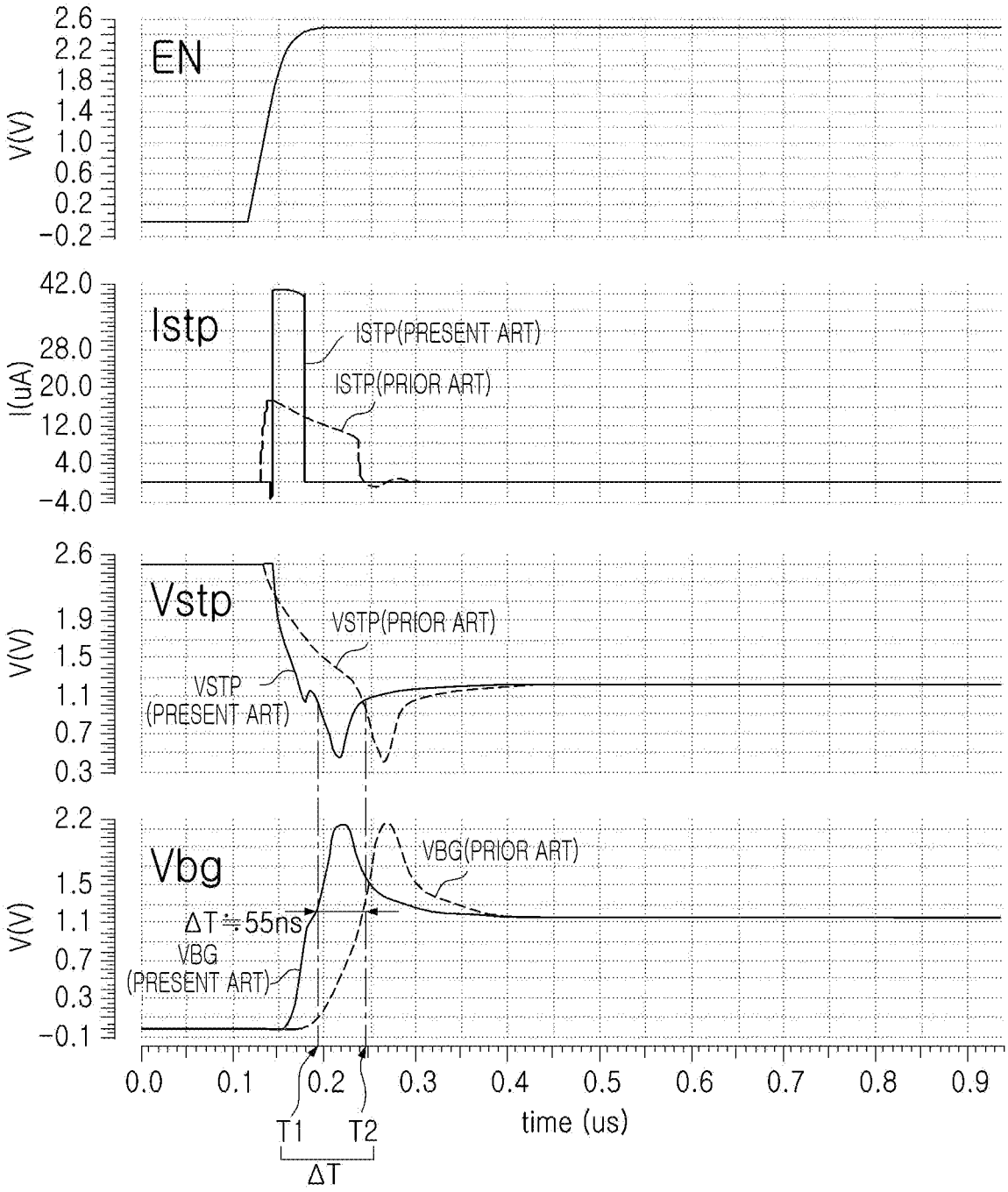
FIG. 4 illustrates each waveform diagram and timing chart for the main signal and voltages, in accordance with one or more embodiments.

FIG. 4 illustrates an example of each waveform diagram and timing chart of the main signal and voltages, in accordance with one or more embodiments.

Referring to FIG. 4, the EN may refer to an enabling signal corresponding to a reception ON of the low noise amplifier (LNA) applied to the time division duplex (TDD) type wireless communication terminal, or an enabling signal corresponding to a transmission ON of a power amplifier (PA) applied to the time division duplex (TDD) type wireless communication terminal.

The Istp may refer to the startup current flowing from an output terminal of the startup circuit 100 to the ground.

The Vstp may refer to the voltage output through the output terminal of the startup circuit 100, and may refer to the startup voltage input to the bandgap reference core circuit 200.

As the startup current Istp flows rapidly from the output terminal of the startup circuit 100 to the ground when compared to the prior circuit without the logic circuit, the startup voltage Vstp may be rapidly decreased to have the low voltage level as compared to the prior circuit.

Accordingly, the bandgap voltage Vbg output to the bandgap reference core circuit 200 may be rapidly increased to the normal voltage (e.g., 1.1 V or more) based on the startup voltage Vstp. When compared to the typical circuit, a driving time point T1 of the examples may also be faster than a driving time point T2 of the typical circuit by a predetermined time (T1−T2=ΔT=55 ns).

Figure 5:
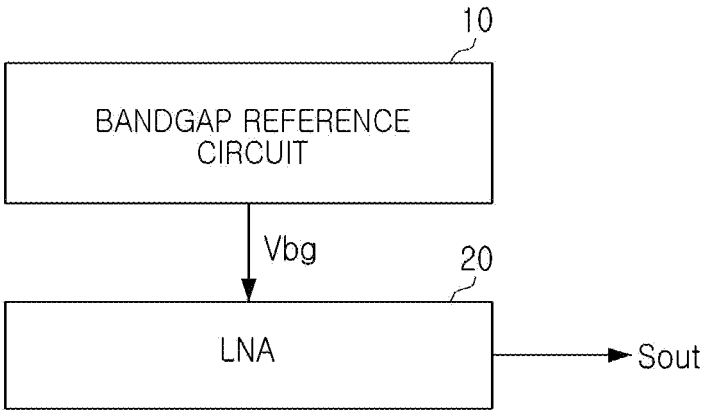
FIG. 5 illustrates an example bandgap reference circuit, in accordance with one or more embodiments.

FIG. 5 illustrates an example bandgap reference circuit, in accordance with one or more embodiments.

Referring to FIG. 5, the bandgap reference circuit 10 may supply the bandgap voltage Vbg to a low noise amplifier (LNA) 20.

Figure 6:
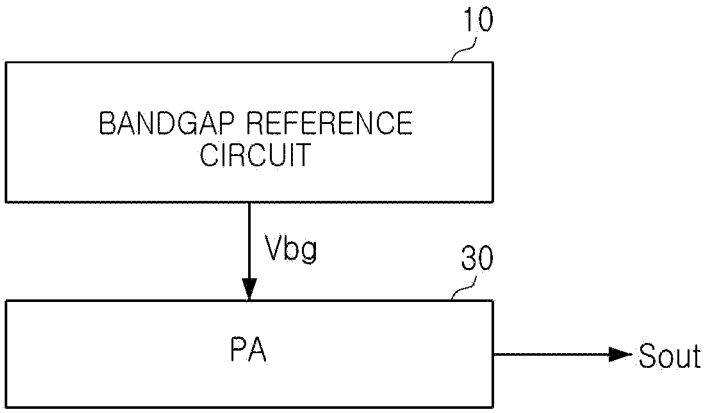
FIG. 6 illustrates an example bandgap reference circuit, in accordance with one or more embodiments.

FIG. 6 illustrates an example bandgap reference circuit, in accordance with one or more embodiments.

Referring to FIG. 6, the bandgap reference circuit 10 may supply the bandgap voltage Vbg to a power amplifier (PA) 30.

Figure 7:
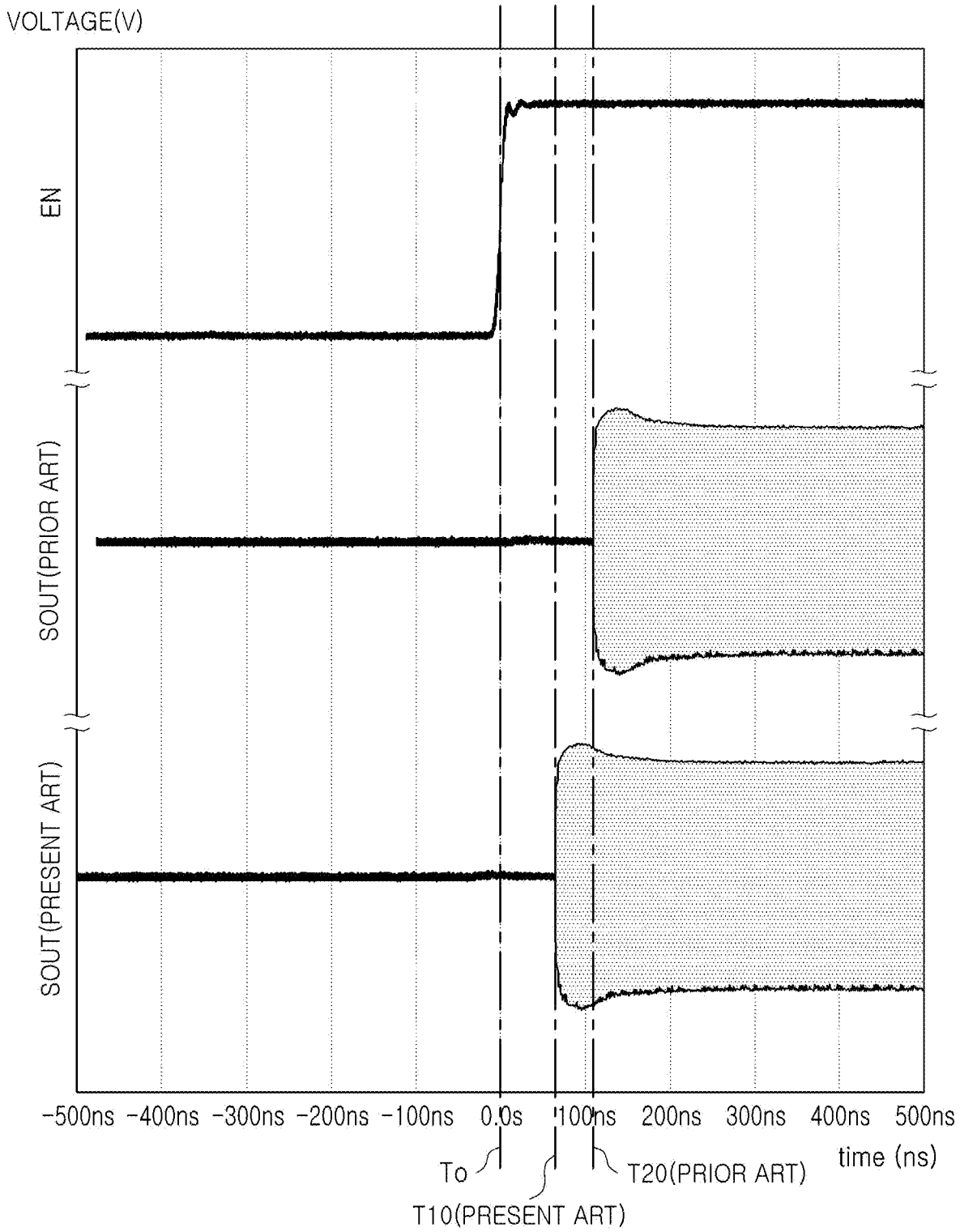
FIG. 7 illustrates an example view of a turn-on point of a low noise amplifier (LNA) in FIG. 5.

FIG. 7 illustrates an example turn-on point of the low noise amplifier (LNA) of FIG. 5.

Referring to FIGS. 5 and 7, the low noise amplifier (LNA) 20 to which the bandgap reference circuit 10 of the examples is applied may receive the bandgap voltage Vbg from the bandgap reference circuit 10, and may output an output signal Sout earlier than a time point when the output signal of the prior low noise amplifier is output.

As set forth above, according to each example, the startup circuit and bandgap reference circuit may have the improved response speed by using the logic element, thereby shortening each turn-on time of the low noise amplifier (LNA) and the power amplifier (PA), which are included in a front-end module (FEM).

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A startup circuit comprising:

a first switch, connected between an operating voltage terminal and a first connection node, and configured to perform a switching operation based on a shutdown signal;

a second switch, connected between the first connection node and a ground, and configured to perform a switching operation based on a bandgap voltage;

a logic circuit configured to perform a logical AND operation on a first voltage of the first connection node and an enabling signal, to generate a switching voltage; and a third switch, connected between an output node and the ground, and configured to perform a switching operation based on the switching voltage, wherein the output node outputs a startup voltage.

2. The startup circuit of claim 1, wherein the first switch includes a field effect transistor (FET) which has a source connected to the operating voltage terminal, a drain connected to the first connection node through a first resistor, and a gate through which the shutdown signal is input.

3. The startup circuit of claim 1, wherein the second switch includes a field effect transistor (FET) which has a drain connected to the first connection node, a source connected to the ground, and a gate through which the bandgap voltage is input.

4. The startup circuit of claim 1, wherein the third switch includes a field effect transistor (FET) which has a drain connected to the output node, a source connected to the ground, and a gate through which the switching voltage is input.

5. The startup circuit of claim 1, wherein the logic circuit includes a logic AND gate which has:

a first input terminal, connected to the first connection node, and configured to receive the first voltage;

a second input terminal, configured to receive the enabling signal; and an output terminal, configured to output the switching voltage which has a voltage level that is based on a result of the logical AND operation performed between the first voltage and the enabling signal.

6. The startup circuit of claim 5, wherein the logic AND gate outputs the switching voltage which has a high voltage level when both the first voltage and the enabling signal have the high voltage level.

7. The startup circuit of claim 6, wherein the high voltage level of the switching voltage is equal to a voltage level of the operating voltage.

8. The startup circuit of claim 1, further comprising a fourth switch connected between the operating voltage terminal and the output node, and configured to perform a switching operation based on the enabling signal, wherein the fourth switch includes a field effect transistor (FET) which has a source connected to the operating voltage terminal, a drain connected to the output node, and a gate through which the enabling signal is input.

9. The start-up circuit of claim 1, wherein the output node outputs a startup voltage to a bandgap reference core circuit, and wherein the bandgap voltage is received from the bandgap reference core circuit.

10. A bandgap reference circuit comprising:

a startup circuit configured to generate a startup voltage; and a bandgap reference core circuit configured to generate a bandgap voltage based on the startup voltage to start operations, wherein the startup circuit comprises:

a first switch, connected between an operating voltage terminal and a first connection node, and configured to perform a switching operation based on a shutdown signal;

a second switch, connected between the first connection node and a ground, and configured to perform a switching operation based on the bandgap voltage;

a logic circuit configured to perform a logical AND operation on a first voltage of the first connection node and an enabling signal, to generate a switching voltage; and a third switch, connected between an output node and the ground, and configured to perform a switching operation based on the switching voltage, wherein the output node outputs a startup voltage.

11. The bandgap reference circuit of claim 10, wherein the first switch includes a field effect transistor (FET) which has a source connected to the operating voltage terminal, a drain connected to the first connection node through a first resistor, and a gate through which the shutdown signal is input.

12. The bandgap reference circuit of claim 10, wherein the second switch includes a field effect transistor (FET) which has a drain connected to the first connection node, a source connected to the ground, and a gate through which the bandgap voltage is input.

13. The bandgap reference circuit of claim 10, wherein the third switch includes a field effect transistor (FET) which has a drain connected to the output node, a source connected to the ground, and a gate through which the switching voltage is input.

14. The bandgap reference circuit of claim 10, wherein the logic circuit includes a logic AND gate which has:

a first input terminal, connected to the first connection node, and configured to receive the first voltage;

a second input terminal, configured to receive the enabling signal; and an output terminal, configured to output the switching voltage which has a voltage level that is based on a result of the logical AND operation performed between the first voltage and the enabling signal.

15. The bandgap reference circuit of claim 14, wherein the logic AND gate outputs the switching voltage which has a high voltage level when both the first voltage and the enabling signal have the high voltage level.

16. The bandgap reference circuit of claim 15, wherein the high voltage level of the switching voltage is equal to a voltage level of the operating voltage.

17. The bandgap reference circuit of claim 10, wherein the startup circuit further includes a fourth switch connected between the operating voltage terminal and the output node, and configured to perform a switching operation based on the enabling signal, and wherein the fourth switch includes a field effect transistor (FET) which has a source connected to the operating voltage terminal, a drain connected to the output node, and a gate through which the enabling signal is input.

18. A communication terminal, comprising:

a bandgap reference circuit including a startup circuit and a bandgap reference core circuit, wherein the startup circuit is configured to:

generate a startup voltage based on an operating voltage, an enabling signal input to an input terminal of a logic circuit of the startup circuit, a shutdown signal input to a gate of a first switch of the startup circuit, and a bandgap voltage received from the bandgap reference core circuit, and output the generated startup voltage to the bandgap reference core circuit; and wherein the bandgap reference core circuit is configured to generate a bandgap voltage and start operations based on the operating voltage and the startup voltage.

19. The communication terminal of claim 18, wherein the startup circuit comprises:

a first switch, connected between an operating voltage terminal and a first connection node, and configured to perform a switching operation based on the shutdown signal;

a second switch, connected between the first connection node and a ground, and configured to perform a switching operation based on a bandgap voltage;

a logic circuit configured to perform a logical AND operation on a first voltage of the first connection node and the enabling signal, to generate a switching voltage; and a third switch, connected between an output node and the ground, and configured to perform a switching operation based on the switching voltage.

20. The communication terminal of claim 19, wherein a value of the startup voltage decreases when a value of a startup current flowing through the third switch increases.

* * * * *